United States Patent [19]

Latassa

[11] 4,097,779

[45] Jun. 27, 1978

[54] FLUORESCENT LAMP CONTAINING A CATHODE HEATER CIRCUIT DISCONNECT DEVICE

[75] Inventor: Frank M. Latassa, Magnolia, Mass.

[73] Assignee: GTE Sylvania Incorporated, Danvers, Mass.

[21] Appl. No.: 673,822

[22] Filed: Apr. 5, 1976

[51] Int. Cl.[2] ..... H05B 41/18

[52] U.S. Cl. ..... 315/106; 315/73; 315/74; 315/107

[58] Field of Search ..... 315/46–49, 315/57, 73, 74, 94, 98, 106, 107, 119, 362; 328/270

[56] References Cited

U.S. PATENT DOCUMENTS

| | | | |
|---|---|---|---|
| 2,330,312 | 9/1943 | Raney, Jr. | 315/98 |
| 2,354,421 | 7/1944 | Pennybacker et al. | 315/73 X |
| 2,462,335 | 2/1949 | Reinhardt | 315/73 |
| 3,982,153 | 9/1976 | Burdick et al. | 315/106 X |

FOREIGN PATENT DOCUMENTS

| | | | |
|---|---|---|---|
| 65,193 | 11/1946 | Denmark | 315/49 |

*Primary Examiner*—Eugene R. La Roche
*Attorney, Agent, or Firm*—James Theodosopoulos

[57] ABSTRACT

A rapid start fluorescent lamp contains a circuit opening device on the cathode mount which opens a short time after lamp starting and stops heater current flow to the cathode.

1 Claim, 1 Drawing Figure

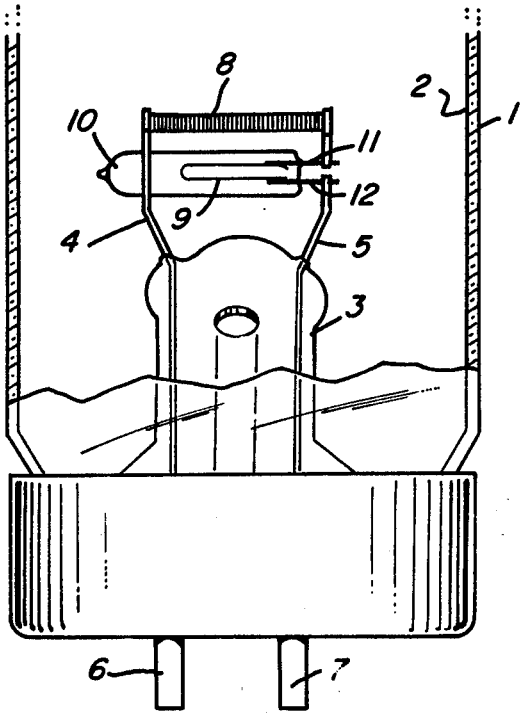
8
2
1
10
11
12
9
4
5
3
6
7

FLUORESCENT LAMP CONTAINING A CATHODE HEATER CIRCUIT DISCONNECT DEVICE

THE INVENTION

This invention concerns fluorescent lamps and especially rapid start lamps. A fluorescent lamp is a low pressure arc discharge lamp having an elongated glass envelope with a phosphor coating on the inner wall thereof, containing an inert gas and a small amount of mercury and having an electrode at each end.

In a rapid start lamp there is constant heater current flow (as distinguished from arc discharge current flow) through each electrode both during lamp ignition and operation. In contrast, a preheat type of fluorescent lamp has heater current flowing through the electrode only during lamp ignition. After ignition, an external voltage-sensitive starter opens the heater current circuit. An instant start type of fluorescent lamp does not employ heater current, even during lamp ignition, depending on high voltage alone to start the lamp.

Rapid start fluorescent lamps are used more often than the others because their ballast costs are lower and/or they have a longer useful life.

A disadvantage to the rapid start lamp is that some power is lost in maintaining heater current flow through the electrodes during operation. It is the purpose of this invention to eliminate such lost power, thereby reducing energy consumption and thereby more efficiently utilizing our energy resources.

This invention utilizes a circuit opening device to open the heater current circuit after lamp ignition. The circuit opening device is disposed sufficiently proximate the electrode in order to be activated by heat from the electrode.

The single FIGURE in the drawing is an elevational view, partly in section, of one end of a fluorescent lamp in accordance with this invention.

The lamp comprises a glass envelope 1 having a phosphor 2 thereon. A glass stem mount 3 is sealed to the end of envelope 1. Embedded in and extending through mount 3 are lead-in wires 4 and 5 which are connected to external pins 6 and 7 respectively. A coiled electrode 8 is connected to and supported on the upper end of lead-in wire 4. Electrode 8 is the usual type of electrode used in rapid start fluorescent lamps and contains the usual emissive coating thereon. Electrode 8 is also sometimes called a cathode or a heater. The other end of electrode 8 is connected to lead-in wire 5 through a thermally sensitive switch which, in this embodiment, comprises a bimetal 9 within a glass bottle 10. Bimetal 9 is normally closed at room temperature and is electrically connected between electrode 8 and lead-in wire 5 by means of wires 11 and 12 which extend through glass bottle 10.

In operation, when the lamp is energized, a ballast circuit (not shown) supplies heater current to electrode 8 by means of pins 6 and 7; it similarly supplies heater current to the other electrode at the other end of the lamp. The ballast circuit also establishes a voltage between the electrodes. Within about 1 or 2 seconds, the heater current heats up the electrodes sufficiently to render the emitter material thereon emissive, and the voltage between the electrodes initiates an arc discharge therebetween. Within a short time bimetal 9 is heated to its opening temperature by the heat from electrode 8 and opens, thereby opening the heater current circuit and stopping heater current flow. The arc discharge current flowing between the electrodes is sufficient to maintain the electrodes thermally emissive.

The operating temperature of fluorescent lamp electrodes is generally about 1000° C and the opening temperature of bimetal 9, in one example, was about 180° to 240° C.

When the circuit opening device of this invention comprises a bimetal, as in the above example, there is an advantage in enclosing it within bottle 10 as shown. The reason is that a bare bimetal could act as an anode and prevent lamp ignition in a situation where the lamp was turned off and then immediately turned on. The bimetal would not cool off sufficiently to close and the lamp would be hung up in a glow discharge between the electrode and the proximate bare bimetal, with the result that the bimetal would not close and lamp ignition would not occur.

It is within the scope of this invention to employ other thermally actuated circuit opening devices instead of a bimetal switch such as, for example, a positive temperature coefficient thermistor. The resistance of such a thermistor above its thermally actuable temperature is so great in relation to its room temperature resistance, say, at least about 100 to 1, that it effectively eliminates heater current above said temperature.

The power saving obtained by this invention is about 3 to 8%.

I claim:

1. In a rapid start type of fluorescent lamp comprising an elongated glass envelope having a phosphor coating on the inner wall thereof and having an electrode at each end thereof and means to supply heater current to said electrode, the improvement which comprises a thermally actuable circuit opening device proximate said electrode, said device being normally closed at room temperature and thereby permitting heater current to flow through said electrode during lamp start up, said device becoming open after lamp ignition as a result of heat from said electrode, thereby stopping said heater current flow, said device comprising a U shaped bimetallic element enclosed in a sealed glass bottle and supported therein by two wires extending through the glass bottle seal, said electrode being mounted on a glass stem mount having two lead-in wires extending therethrough, one of said lead-in wires being connected to one end of said electrode and the other of said lead-in wires being connected to one of the wires that extends through the glass bottle seal, the other end of said electrode being connected to the other of the wires that extends through the glass bottle seal.

* * * * *